US007494328B2

(12) United States Patent
Bhatia et al.

(10) Patent No.: US 7,494,328 B2
(45) Date of Patent: Feb. 24, 2009

(54) NVH AND GAS PULSATION REDUCTION IN AC COMPRESSOR

(75) Inventors: Kanwal Bhatia, Troy, MI (US); Rodney James Callahan, Novi, MI (US); Kastriot Shaska, Waterford, MI (US)

(73) Assignee: Visteon Global Technologies, Inc., Van Buren Township, MI (US)

( * ) Notice: Subject to any disclaimer, the term of this patent is extended or adjusted under 35 U.S.C. 154(b) by 509 days.

(21) Appl. No.: 11/175,507

(22) Filed: Jul. 6, 2005

(65) Prior Publication Data

US 2007/0020132 A1 Jan. 25, 2007

(51) Int. Cl.
*F04B 39/00* (2006.01)
*F04B 53/00* (2006.01)
*F04B 1/12* (2006.01)
*F04B 27/08* (2006.01)

(52) U.S. Cl. ..... 417/312; 417/269

(58) Field of Classification Search ..... 417/559, 417/312; 181/139; 62/296
See application file for complete search history.

(56) References Cited

U.S. PATENT DOCUMENTS 3,577,891 A 5/1971 Nemoto et al.
3,785,751 A 1/1974 Nemoto et al.
4,360,076 A * 11/1982 Suyama ..... 181/265
4,580,656 A * 4/1986 Fukuda ..... 181/252
4,679,597 A 7/1987 Stein
4,690,619 A 9/1987 Iijima et al.
4,715,790 A 12/1987 Iijima et al.
4,761,119 A 8/1988 Nomura et al.
4,784,583 A 11/1988 Bar
4,898,512 A * 2/1990 Geffs ..... 415/1
4,929,157 A 5/1990 Steele et al.
4,934,482 A 6/1990 Herron et al.
5,088,897 A * 2/1992 Kawai et al. ..... 417/269
5,133,647 A 7/1992 Herron et al.
5,183,974 A 2/1993 Wilhelm et al.
5,401,150 A * 3/1995 Brown ..... 418/181
5,533,871 A * 7/1996 Takenaka et al. ..... 417/269
5,556,265 A 9/1996 Michiyuki et al.
5,580,224 A 12/1996 Ikeda et al.
5,645,405 A * 7/1997 Ota et al. ..... 417/269
5,702,236 A 12/1997 Ikeda
5,733,107 A 3/1998 Ikeda et al.
5,899,670 A * 5/1999 Ikeda et al. ..... 417/312
5,957,664 A 9/1999 Stolz et al.
6,015,269 A 1/2000 Ota et al.

(Continued)

*Primary Examiner*—Devon C Kramer
*Assistant Examiner*—Alexander B Comley
(74) *Attorney, Agent, or Firm*—Brinks, Hofer, Gilson & Lione

(57) ABSTRACT

A rear housing for a compressor reduces NVH without increasing the overall size of the compressor or inducing flow loss. Generally, the compressor includes a cylinder block receiving lower pressure fluid from the rear housing and providing higher pressure fluid back to the rear housing. The rear housing includes an annular outer wall and an annular inner wall defining a suction chamber and a discharge chamber. An inlet is in fluid communication with the suction chamber. An outlet is in fluid communication with the discharge chamber. The outlet includes a discharge passageway having a tubular member projecting into the discharge chamber. The tubular member is defined by a side wall and a closed end wall. The side wall includes a plurality of holes fluidically connecting the discharge chamber and the discharge passageway.

19 Claims, 3 Drawing Sheets

U.S. PATENT DOCUMENTS 6,149,397 A 11/2000 Mizutani et al.
6,158,983 A * 12/2000 Harpole et al. ..... 417/410.4
6,293,768 B1 * 9/2001 Shintoku et al. ..... 417/312
6,296,457 B1 * 10/2001 Shintoku et al. ..... 417/312
6,382,938 B1 5/2002 Murao et al.
6,386,846 B1 5/2002 Murase et al.
6,402,483 B1 * 6/2002 Kawamura et al. ..... 417/269
6,481,240 B2 11/2002 Strikis et al.
6,494,930 B2 12/2002 Strikis et al.
6,497,114 B1 12/2002 Strikis et al.
6,523,455 B1 2/2003 Callahan et al.
6,536,230 B2 3/2003 Coyle et al.
6,568,914 B2 5/2003 Ahn
6,568,920 B2 5/2003 Yttri et al.
6,568,924 B2 5/2003 Kawamura et al.
6,568,925 B2 5/2003 Gunderson
6,575,708 B2 * 6/2003 DeWispelaere ..... 417/269
6,579,071 B1 6/2003 Tarutani et al.
6,668,801 B2 12/2003 Smith et al.
6,705,843 B1 3/2004 Kuo
7,000,420 B2 * 2/2006 Ahn et al. ..... 62/296
2003/0000588 A1 * 1/2003 Kuykendal et al. ..... 138/26
2004/0129794 A1 * 7/2004 Deichmann et al. ..... 239/17
2005/0031477 A1 * 2/2005 Hibino et al. ..... 417/559

* cited by examiner

NVH AND GAS PULSATION REDUCTION IN AC COMPRESSOR

FIELD OF THE INVENTION

The present invention relates generally to compressors and pumps, and more particularly relates to reducing fluid pulsations, noise, vibration and harshness from such compressors and pumps.

BACKGROUND OF THE INVENTION

Existing compressors, such as air conditioning compressors found in vehicles, are relatively noisy. In normal use, a fluid such as a refrigerant gas enters the compressor via a suction chamber in the rear housing of the compressor. The fluid then proceeds through the cylinder block and its chambers where it is drawn into and exited by reciprocating piston movement, which compresses the fluid and discharges it out of the pump. The discharge fluid exits the compressor via a discharge chamber also located in the rear housing and positioned adjacent the suction chamber. Compression of the fluid via the series of reciprocating pistons results in large pressure pulsations and fluctuations, which in turn result in the generation of noise, vibration and harshness (NVH).

Many compressors include built-in flow noise control devices, such as a muffler. Unfortunately, these devices are usually a bulky addition to the compressor casting or housing, increasing the overall size and mass of the compressor significantly. Other drawbacks include a large flow loss due to the structure of the channels linking the muffler and compressor.

Accordingly, there exists a need to provide a compressor and rear housing which reduces NVH without increasing the overall size of the compressor or inducing flow loss.

BRIEF SUMMARY OF THE INVENTION

The present invention provides a rear housing for a compressor which reduces NVH without increasing the overall size of the compressor or inducing flow loss. Generally, the compressor includes a cylinder block receiving lower pressure fluid from the rear housing and providing higher pressure fluid back to the rear housing. The rear housing includes an annular outer wall and an annular inner wall defining a suction chamber and a discharge chamber. The suction chamber contains the lower pressure fluid while the discharge chamber contains the higher pressure fluid. An inlet is in fluid communication with the suction chamber. An outlet is in fluid communication with the discharge chamber. The outlet includes a discharge passageway having a tubular member projecting into the discharge chamber. The tubular member is defined by a side wall and a closed end wall. The side wall includes a plurality of holes fluidically connecting the discharge chamber and the discharge passageway. The combined cross-sectional area of the plurality of holes is substantially equal to the cross-sectional area of the discharge passageway, thereby providing adequate fluid flow with minimal loss.

According to more detailed aspects, the plurality of holes preferably includes at least three holes. Each of the plurality of holes may be equidistantly spaced from the end wall. Alternatively, a portion of the plurality holes may be spaced non-equidistantly from the end wall. The holes are also preferably circumferentially spaced equidistantly around the side wall of the tubular member. The entire circumference of the side wall of the tubular member that contains the plurality of holes may be exposed to the fluid within the discharge chamber.

According to further detailed aspects, the higher pressure fluid in the discharge chamber has pulsations, and the length of the tubular member may be sized to correspond to the frequency of the pulsations. Similarly, the number of holes comprising the plurality of holes is selected based on the amplitude of the pulsations, and in particular the desired reduction of the amplitude. When the discharge passageway includes a bend, the length is measured from the bend to the closed end wall. The rear housing may further include a muffler wall positioned inside the inner wall and defining a muffler chamber. The muffler wall includes openings linking the discharge chamber to the muffler chamber, while the tubular member projects into the muffler chamber such that the plurality of openings are located within the muffler chamber.

Another embodiment of the present invention includes a rear housing for a compressor having a cylinder block receiving lower pressure fluid from the rear housing and providing higher pressure fluid back to the rear housing. The rear housing includes annular outer and inner walls defining a suction chamber and a discharge chamber. The suction chamber contains lower pressure while the discharge chamber contains the higher pressure fluid. An inlet is in fluid communication with the suction chamber. An outlet is in fluid communication with the discharge chamber. The outlet includes a discharge passageway having a tubular member projecting into the discharge chamber. The tubular member is defined by a side wall and a closed end wall. The outer wall has a plurality of holes fluidically connecting the discharge chamber and the discharge passageway. The plurality of holes are circumferentially spaced around the side wall of the tubular member and are equidistantly spaced from the closed end wall along the length of the discharge passageway.

BRIEF DESCRIPTION OF THE DRAWINGS

The accompanying drawings incorporated in and forming a part of the specification illustrate several aspects of the present invention, and together with the description serve to explain the principles of the invention. In the drawings.

DETAILED DESCRIPTION OF THE INVENTION

Figure 1:
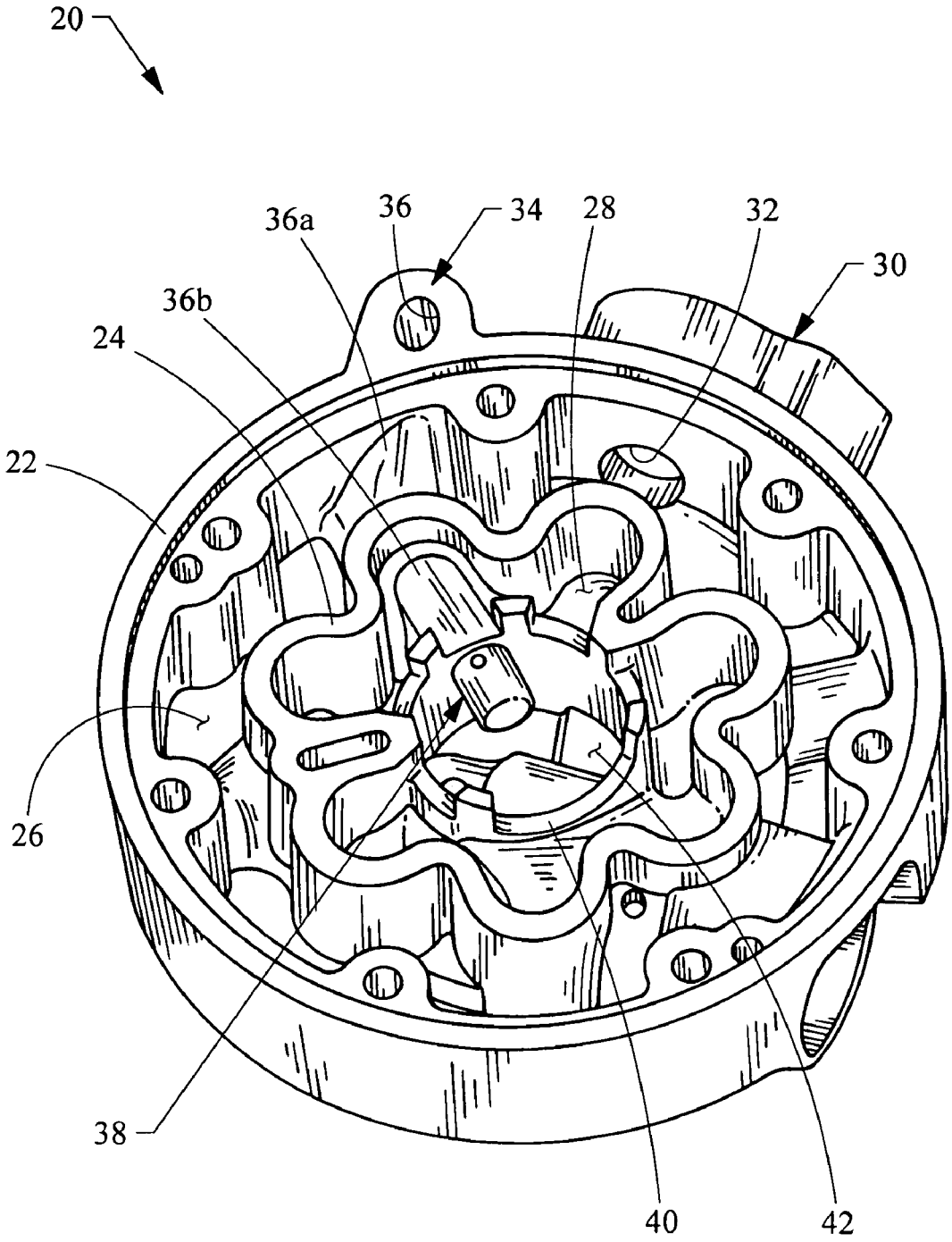
FIG. 1 is a perspective view of a rear housing constructed in accordance with the teachings of the present invention.
Figure 2:
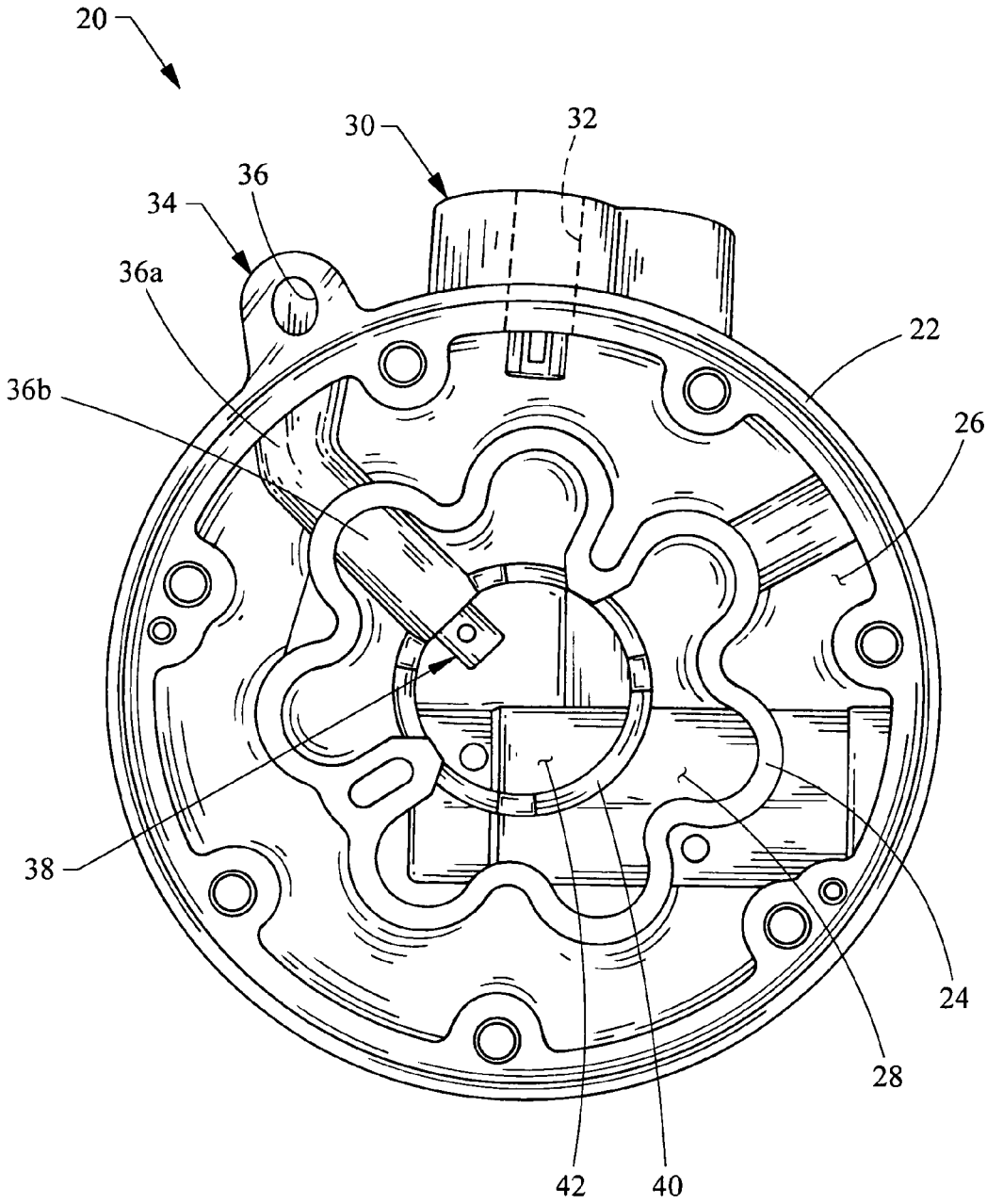
FIG. 2 is a top view of the rear housing depicted in FIG. 1.

Turning now to the figures, FIGS. 1 and 2 illustrate a rear housing 20 that is designed for reducing the pressure pulsations and NVH in a compressor (not shown). A compressor for an automotive HVAC typically includes a cylinder block receiving lower pressure fluid from the rear housing 20 and providing higher pressure fluid back to the rear housing 20 through the reciprocating movement of pistons within the cylinder block. The rear housing 20 is in communication with the cylinder block in order to route the flow of higher and lower pressure fluid to and from the compressor. The rear housing 20 generally includes an outer wall 22 and an inner wall 24 positioned inside the outer wall 22. Both the inner and outer walls 22, 24 are annular in shape. As used herein, "annular" refers to a ring-shaped structure (i.e. having no particular beginning or end), although not necessarily circular. For example, the inner wall 24 has a flower-shape defined by a series of "petals" which correspond with individual reciprocating pistons of the cylinder block. The volume between the outer wall 22 and the inner wall 24 defines a suction chamber 26 which is utilized to supply low pressure fluid to the compressor. The interior space within the inner wall 24 defines a discharge chamber 28 for receiving high pressure fluid from the compressor.

The suction chamber 26 is provided with low pressure fluid via an inlet 30 which includes a suction passageway 32 fluidically connected to the suction chamber 26. Similarly, the discharge chamber 28 is fluidically connected to an outlet 34 defined by a discharge passageway 36. The discharge passageway 36 generally includes a first portion 36*a* extending through the suction chamber 26 and a second portion 36*b* extending through the discharge chamber 28. It will be recognized by those skilled in the art that while the discharge chamber 28 has been shown positioned inside of the suction chamber 26, the chambers could easily be reversed such that the discharge chamber 28 is located between the inner and outer walls 22, 24 while the suction chamber is positioned inside of the inner wall 24.

It can also be seen that the rear housing 20 depicted in FIGS. 1 and 2 includes a muffler wall 40 that is also annular in shape and positioned inside of the inner wall 24. The muffler wall 40 defines a muffler chamber 42 which forms a portion of and is linked to the discharge chamber 28 via a plurality of openings 50. This muffler structure provides additional attenuation of flow turbulence and pressure pulsations in the discharge fluid of the compressor, as more fully described in U.S. Pat. No. 6,705,843, issued Mar. 16, 2004, the disclosure of which is incorporated herein by reference in its entirety.

The outlet 34 and discharge passageway 36 includes a tubular member 38 projecting within the discharge chamber 28, and as shown in the figures, also projects within the muffler chamber 42. The tubular member 38 and discharge passageway 36 are structured to provide a reduction in the pressure pulsations in the fluid discharged by the cylinder block and its reciprocating pistons, as further discussed below. Notably, the tubular member 38 is a simple structure which fits within the existing space of the discharge chamber 28, thereby resulting in a very minimal weight addition and no appreciable increase in size of the compressor or rear housing 20.

Figure 3:
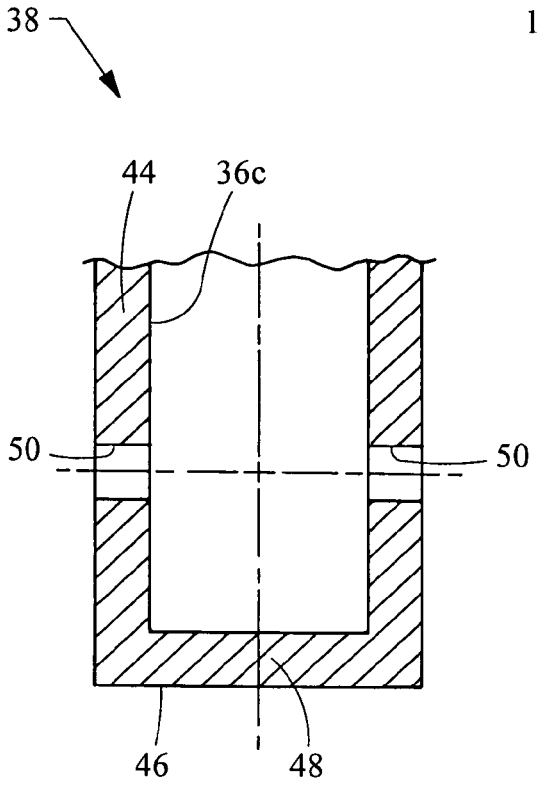
FIG. 3 is a cross-sectional view through the discharge chamber forming a portion of the rear housing depicted in FIGS. 1 and 2.
Figure 4:
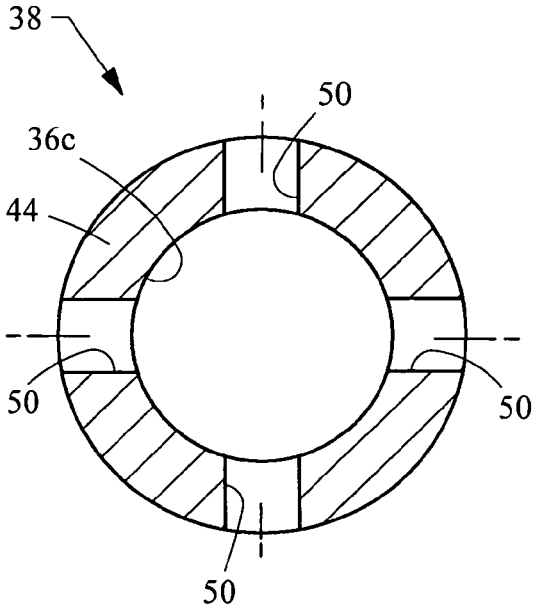
FIG. 4 is another cross-sectional view of the discharge passageway forming a portion of the rear housing depicted in FIGS. 1 and 2.

As shown in the cross-sectional views of FIGS. 3 and 4, the tubular member 38 generally includes a side wall 44 and a free end 46 which is closed by an end wall 48. That is, the closed end wall 48 does not provide any passage of fluid therethrough. Rather, the side wall 44 includes a plurality of holes 50 fluidically connecting the discharge chamber 28 and the discharge passageway 36. In particular, the tubular member 38 defines a third portion 36*c* of the discharge passageway 36 and outlet 34. Preferably, the plurality of holes 50 include at least three holes, and the embodiment depicted includes four holes 50, as best seen in FIG. 4.

In order to provide little to no flow loss of the discharge fluid, the combined cross-sectional area of the plurality of holes 50 is substantially equal to the cross-sectional area of the discharge passageway 36, and more particularly the third portion 36*c* of the discharge passageway as defined by the tubular member 38. By the term substantially, it is meant that the combined area of the plurality of holes 50 is within 10% of the area of the discharge passageway 36*c*, since over 80% of the compressor performance is calculated to be maintained when the areas are within 10% of each other. In this manner, there is little to no flow loss of discharge fluid, while at the same time the amplitude of pressure pulsations is reduced by forcing the discharge fluid to pass through one of the holes 50 which is smaller than the discharge passageway 36. The relation between the diameter (D) of the discharge passageway 36 and the diameter (d) of each small hole 50 can be expressed as $D=\sqrt{n \cdot d \cdot d}$, wherein n=the number of small holes 50. Thus, the smaller the diameter of each hole 50, and hence the more holes 50, the more muffling action and reduction in amplitude of the outputted discharge fluid pulsations.

Furthermore, the length of the discharge passageway 36, and particularly the length of the second and third portions 36*b*, 36*c* (i.e. before any bends or any other disturbances in the discharge passageway 36), in combination with the distance between the plurality of holes 50 and the closed end wall 48, can be used to control which frequencies of the discharge fluid are most affected. Accordingly, by controlling the number of holes 50, as well as the length of discharge passageway 36 and the positioning of the holes 50 there along, the rear housing 20 can be "tuned" to reduce the amplitude of pressure pulsations at specified frequencies.

Figure 5:
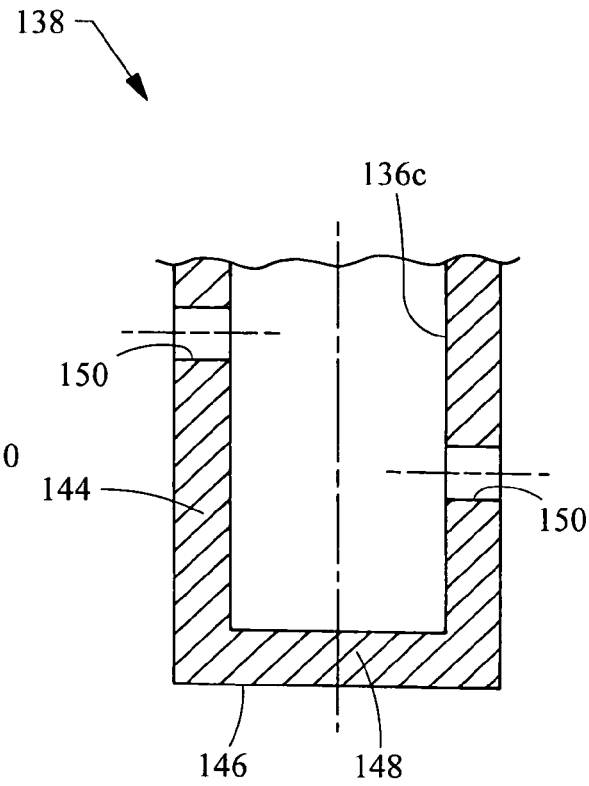
FIG. 5 is a cross-sectional view similar to FIG. 3 but showing an alternate embodiment of the discharge passageway.

As shown in FIG. 3, the plurality of holes 50 are equidistantly spaced from the closed end wall 48, and as shown in FIG. 4, are circumferentially spaced equidistantly about the side wall 44 of the tubular member 38. It can also be seen in FIG. 1 that the entire outer circumference of the portion of the tubular member 38 containing the holes 50 is exposed to the discharge chamber 28. However, it will be recognized by those skilled in the art that the plurality of holes 50 need not be circumferentially spaced equidistantly about the tubular member 38, and likewise that the plurality of holes 50 need not be equidistantly spaced from the closed end wall 48. For example, and as shown in the cross-section view of FIG. 5, an alternate embodiment of the tubular member 138 is shown defining a discharge passageway portion 136*c*. The tubular member 138 includes a side wall 144 and a closed distal end 146 which is sealed by way of an end wall 148. In this embodiment, the plurality of holes 150 formed in the side wall 144 are spaced different distances from the closed end wall 148, which provides for a tuning of the frequencies in which the pulsations of the discharge fluid is reduced. As in the prior embodiment, the combined cross-sectional area of the plurality of holes 150 is preferably substantially equal to the cross-sectional area of the discharge passageway portion 136*c*, thereby minimizing any potential flow loss in the discharge fluid.

Accordingly, it will be recognized by those skilled in the art that simply by structuring the discharge passageway of the outlet in the rear housing 20 to include a closed end and a plurality of linking holes, the amplitude of pressure pulsations in the discharge fluid can greatly be reduced. The structure can also be designed to address pulsations of certain frequencies. Furthermore, by controlling the size of the plurality of holes formed at the end of the discharge passageway, flow losses can essentially be eliminated.

The foregoing description of various embodiments of the invention has been presented for purposes of illustration and description. It is not intended to be exhaustive or to limit the invention to the precise embodiments disclosed. Numerous modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

The invention claimed is:

1. A rear housing for a compressor having a cylinder block receiving lower pressure fluid from the rear housing and providing higher pressure fluid back to the rear housing, the rear housing comprising:

annular outer and inner walls defining a suction chamber and a discharge chamber, the suction chamber containing the lower pressure fluid, the discharge chamber containing the higher pressure fluid;

an inlet in fluid communication with the suction chamber;

an outlet in fluid communication with the discharge chamber, the outlet including a discharge passageway having a tubular member projecting into the discharge chamber; and the tubular member defined by a side wall and a closed end wall, the side wall having a plurality of holes fluidically connecting the discharge chamber and the discharge passageway, the combined cross-sectional area of the plurality of holes being substantially equal to the cross-sectional area of the discharge passageway.

2. The rear housing of claim 1, wherein the plurality of holes includes at least three holes.

3. The rear housing of claim 1, wherein each of the plurality of holes are spaced equidistantly from end wall.

4. The rear housing of claim 1, wherein a portion of the plurality of holes are spaced non-equidistantly from end wall.

5. The rear housing of claim 1, wherein the plurality of holes are circumferentially spaced equidistantly around the side wall of the tubular member.

6. The rear housing of claim 1, wherein the tubular member extends linearly.

7. The rear housing of claim 1, wherein the entire circumference of the side wall of the tubular member that contains the plurality of holes is exposed to the fluid within the discharge chamber.

8. The rear housing of claim 1, wherein the higher pressure fluid in the discharge chamber has pulsations, and wherein the length of the tubular member is sized to correspond to the frequency of the pulsations.

9. The rear housing of claim 8, wherein the discharge passageway includes a bend, and wherein the length is measured from the bend to the closed end wall.

10. The rear housing of claim 9, wherein the discharge chamber is defined by the interior of the inner wall, and wherein the discharge passageway extends through both the suction chamber and discharge chamber, the bend being located proximate the inner wall.

11. The rear housing of claim 1, wherein the higher pressure fluid in the discharge chamber has pulsations, and wherein the number of holes comprising the plurality of holes is selected based on the amplitude of the pulsations.

12. The rear housing of claim 1, further comprising a muffler wall positioned inside the inner wall and defining a muffler chamber forming a portion of the discharge chamber, the tubular member projecting into the muffler chamber and the plurality of openings being located within the muffler chamber.

13. A rear housing for a compressor having a cylinder block receiving lower pressure fluid from the rear housing and providing higher pressure fluid back to the rear housing, the rear housing comprising:

annular outer and inner walls defining a suction chamber and a discharge chamber, the suction chamber containing the lower pressure fluid, the discharge chamber containing the higher pressure fluid;

an inlet in fluid communication with the suction chamber;

an outlet in fluid communication with the discharge chamber, the outlet including a discharge passageway having a tubular member projecting into the discharge chamber; and the tubular member defined by a side wall and a closed end wall, the side wall having a plurality of holes fluidically connecting the discharge chamber and the discharge passageway, the plurality of holes being circumferentially spaced around the side wall of the tubular member, each of the plurality of holes being equidistantly spaced from the closed end wall.

14. The rear housing of claim 13, wherein the combined cross-sectional area of the plurality of holes is substantially equal to the cross-sectional area of the discharge passageway.

15. The rear housing of claim 13, wherein the plurality of holes includes at least three holes.

16. The rear housing of claim 13, wherein the entire circumference of the side wall of the tubular member that contains the plurality of holes is exposed to the fluid within the discharge chamber.

17. The rear housing of claim 13, wherein the higher pressure fluid in the discharge chamber has pulsations, and wherein the length of the tubular member is sized to correspond to the frequency of the pulsations.

18. The rear housing of claim 13, wherein the higher pressure fluid in the discharge chamber has pulsations, and wherein the number of holes comprising the plurality of holes is selected based on the amplitude of the pulsations.

19. The rear housing of claim 13, further comprising a muffler wall positioned inside the inner wall and defining a muffler chamber, the muffler wall including openings linking the discharge chamber to the muffler chamber, the tubular member projecting into the muffler chamber and the plurality of openings being located within the muffler chamber.

* * * * *